United States Patent [19]

Shank

[11] Patent Number: 4,511,054

[45] Date of Patent: Apr. 16, 1985

[54] TAMPER-EVIDENT CLOSURE AND METHOD OF MANUFACTURE

[75] Inventor: Brian E. Shank, Rothsville, Pa.

[73] Assignee: Kerr Glass Manufacturing Corporation, Los Angeles, Calif.

[21] Appl. No.: 600,161

[22] Filed: Apr. 13, 1984

[51] Int. Cl.[3] ..... B65D 41/34

[52] U.S. Cl. ..... 215/252

[58] Field of Search ..... 215/252, 250, 258

[56] References Cited

U.S. PATENT DOCUMENTS

| | | | |
|---|---|---|---|
| 3,673,761 | 7/1972 | Leitz | 53/42 |
| 3,929,246 | 12/1975 | Leitz | 215/252 |
| 4,147,268 | 4/1979 | Patel et al. | 215/252 |
| 4,205,755 | 6/1980 | de Wijn | 215/252 |
| 4,217,989 | 8/1980 | George | 215/253 |
| 4,322,009 | 3/1982 | Mumford | 215/253 |
| 4,458,821 | 6/1984 | Ostrowsky | 215/252 |

*Primary Examiner*—Steven M. Pollard

*Attorney, Agent, or Firm*—Fitch, Even, Tabin & Flannery

[57] ABSTRACT

A method of manufacturing a tamper-evident closure having a detachable annular tamper-indicating portion includes a step of testing the connection between the detachable portion and the remainder of the closure. The testing may comprise either use of optical detection apparatus or use of a deflection measuring system which applies radial pressure to the detachable portion. A tamper-evident closure having a detachable annular tamper-indicating portion includes gaging means to cooperate with optical detection apparatus to enable detection of closures having unacceptable tolerances.

13 Claims, 7 Drawing Figures

FIG. 1
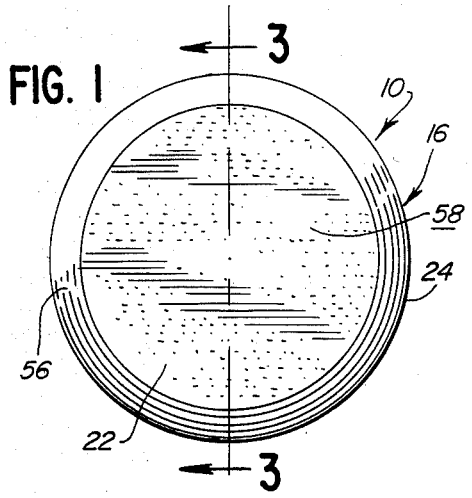
FIG. 3
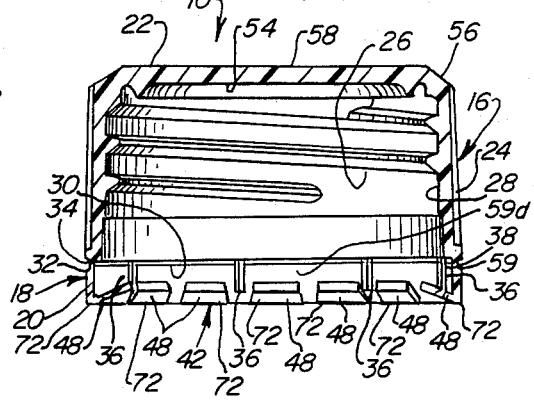
FIG. 2
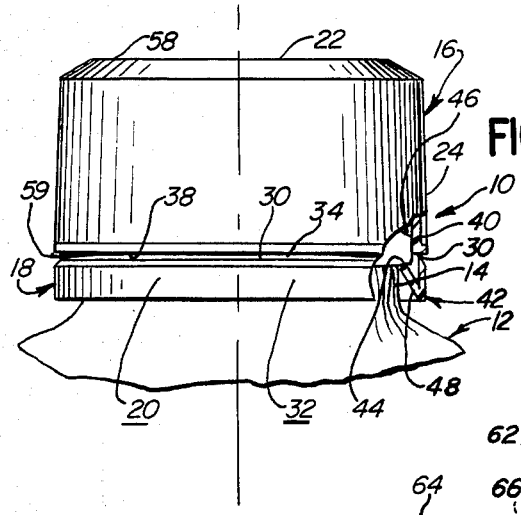
FIG. 6
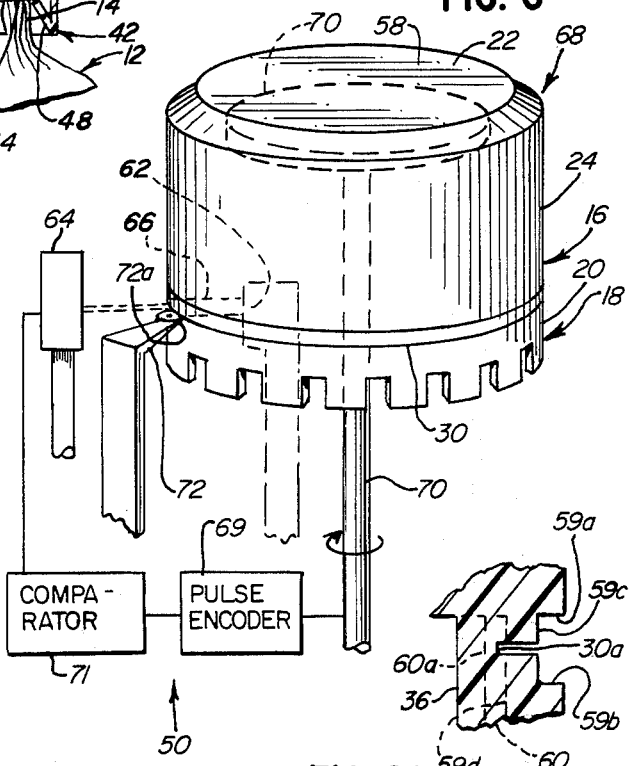
FIG. 5
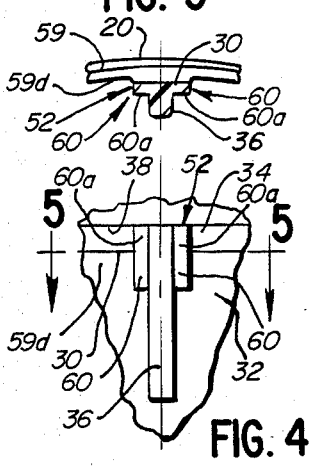
FIG. 4
FIG. 6A
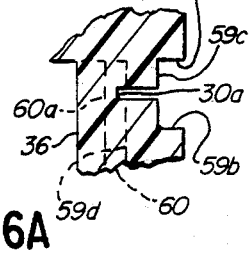

TAMPER-EVIDENT CLOSURE AND METHOD OF MANUFACTURE

BACKGROUND OF THE INVENTION

The present invention relates to tamper-evident closures and methods of manufacture therefor.

Tamper-evident closures of various types have been used in the past on containers to enable the user of a product to determine whether the container has been opened. Such closures have commonly been made of aluminum or plastic. One type of closure includes an upper cap portion and a lower ring portion having a failure line, or line of weakness formed about its circumference. When the cap is removed, the closure breaks along the failure line, leaving a lower portion of the ring separate from the rest of the closure.

Closures of this type are described in copending U.S. patent application Ser. No. 467,873, which is assigned to the assignee of this application and is incorporated herein by reference, and in U.S. Pat. Nos. 4,322,009; 4,205,755; 3,929,246; 3,673,761 and 4,217,989.

One method of manufacturing closures of the above-described variety involves molding a plastic blank having a plurality of lugs connecting the cap portion to the lower portion of the ring, then forming a circumferential cut through the ring adjacent the lugs with a knife or the like, leaving the connecting lugs intact. One difficulty with this type of manufacture is that it is difficult to mass produce closures in this manner with acceptable tolerances. If the cut is too shallow, the lower portion of the ring may not separate properly from the upper portion of the ring upon removal of the closure. This can make the closure difficult to remove, or, in some types of closures, might cause the lower portion of the ring to remain attached to the upper portion after removal, which would defeat the tamper-indicating function of the closure. If the circumferential cut is too deep, it may penetrate the lugs and cause a failure of one or more of the lugs during installation of the closure on its associated container. Such a failure is undesirable not only because it may create a false indication that the closure has been tampered with, but also because the result may be aesthetically unattractive.

SUMMARY OF THE INVENTION

In accordance with one aspect of the present invention, there is provided a method of manufacturing a tamper-evident closure having a removable annular tamper-indicating portion, which method includes a step of testing the connection between the removable portion and the remainder of the closure. The testing may comprise either use of optical detection apparatus or use of a deflection measuring system. In accordance with another aspect of the present invention, there is provided a closure which includes gaging means to cooperate with optical detection apparatus.

Accordingly, it is an object of the present invention to provide an improved method of manufacturing tamper-evident closures.

It is a more specific object of the present invention to provide a method of manufacturing a tamper-evident closure of the type including a cap and a detachable annular tamper-indicating portion, which includes the step of testing the closure to determine the strength of the connection between the detachable portion and the remainder of the cap.

It is an additional object of the present invention to provide a tamper-evident closure which includes a detachable portion and means to facilitate testing of the closure to determine the strength of the connection between the detachable portion and the remainder of the closure.

Further objects and features of the present invention are set forth in the following description and in the accompanying drawings.

BRIEF DESCRIPTION OF THE DRAWINGS

FIG. 1 is a plan view of a closure in accordance with the present invention.

FIG. 2 is a side elevational view of the closure of FIG. 1, shown in installed relation upon a container, with portions broken away and with portions shown in section.

FIG. 3 is a sectional view taken along line 3—3, FIG. 1, and looking in the direction of the arrows.

FIG. 4 is a detail view of a connector post and two gaging posts in the closure of FIG. 1.

FIG. 5 is a sectional view taken along line 5—5 of FIG. 4 and looking in the direction of the arrows.

FIG. 6 is a diagrammatical perspective view illustrating a method of testing the closure of FIG. 1.

FIG. 6A is an enlarged cross-sectional, fragmentary view of the cut and of the connecting and gaging posts of the closure of FIG. 1.

DETAILED DESCRIPTION OF A PREFERRED EMBODIMENT

The present invention is generally embodied in a tamper-evident closure 10 for a container 12 (FIG. 2) having an externally threaded neck 14 with an open top, and in a method of manufacturing the closure 10. The closure 10 includes an internally threaded cap 16 and a tamper-indicating assembly 18 including a ring 20 depending from the cap 16. The cap 16 includes a top wall 22 for extending across the open top of the container 12 and an integral annular skirt or side wall 24 depending from the top wall 22. The side wall 24 has a screw thread 26 formed on its inner surface 28 for engagement with the external thread of the container neck 14.

The tamper-indicating ring 20 has a circumferential gap or cut 30 formed in it to enable a lower portion 32 of the ring 20 to be separated from an upper portion 34 of the ring 20. A plurality of connecting posts 36 extend from the bottom 38 of the cap 16 to the lower portion 32 of the ring 20, detachably connecting the lower portion 32 of the ring to the upper portion 34 of the ring and to the cap 16. When the cap 16 is unscrewed from the container neck 14, the lower portion 32 of the ring is retained on the container neck by an annular projection 40 on the container and breaks away from the cap.

The closure 10 may be installed by screwing it onto the container 12. The ring 20 must be capable of traveling downward over the projection 40 on the container during installation of the closure 10, yet the lower portion 32 of the ring 20 must resist travel upward over the projection 40 during removal of the closure 10.

To this end, retaining means 42 are provided on the lower portion 32 of the ring 20 to facilitate downward travel of the ring 20 over the projection 40, and to engage a lower surface 44 of the projection after installation of the closure 10 to prevent upward travel of the lower portion 32 of the ring 20 past the projection 40. The annular projection 40 on the container 12 may be configured to cooperate with the retaining means 42 by providing an upper camming surface 46 which slopes downward and radially outward to cam the retaining means 42 outward during installation. In the illustrated embodiment, the retaining means 42 comprise a plurality of pivotal, resilient tabs 48 formed integrally with the ring 20 and extending radially inward and upward therefrom. Tabs 48 of this type are described in abovementioned copending application Ser. No. 467,873.

In manufacturing a closure having a circumferential cut which separates a tamper-indicating ring into two separate pieces while leaving intact lugs or connecting posts 36 abutting the inner periphery of the ring, it is desirable that the cut extend entirely through the ring without extending too far into the lugs or connecting posts. If the cut is too deep, the lugs or connecting posts may be too weak and one or more of them may fracture during installation. If the cut is too shallow, the ring may not separate properly during removal of the cap. In the past, it has been difficult to efficiently detect closures wherein the depth of the cut is not within acceptable tolerances. The closures are generally mass produced at rates of, for example, 180 per minute, and manual inspection of the closures one-by-one is costly and inefficient. There is a continuing need for improved methods of mass producing closures which enable detection of flawed closures during manufacture, and for improved tamper-evident closures which may be tested efficiently during manufacture.

In accordance with one aspect of the present invention, a method of manufacturing a tamper-evident closure 10 having a detachable, annular tamper-indicating portion 32 includes a step of testing the connection between the detachable portion 32 and the remainder of the closure 10. The testing may comprise either use of optical detection apparatus 50 for determining what portion of the circumference of the ring 20 is cut, or may comprise a deflection measuring system (not illustrated) which applies radial pressure to the ring 20 between connecting posts 36 and measures deflection of the ring 20 in response to the pressure. In accordance with another aspect of the present invention, there is provided a closure 10 which includes gaging means 52 to cooperate with optical detection apparatus 50 to enable efficient detection of closures having unacceptable tolerances.

Turning first to a more detailed description of the illustrated closure 10, the closure is preferably made of a plastic material such as polypropylene. To seal the top wall 22 of the closure 10 against the open top of an associated container 12, an annular sealing ring 20 extends downwardly from the lower surface 54 of the top wall 22 of the closure. In the alternative, the closure might have a separate liner or seal glued or otherwise fastened to the lower surface of the top wall to engage the open top of the container.

To facilitate gripping of the closure for removal, vertical ribs are disposed about the circumference of the sidewall 24. The closure may have a chamfer 56 formed at the intersection of the sidewall 24 and the top wall 22. The upper surface 58 of the top wall 22 may be stippled. The sidewall 24 may have a gradual increase in diameter proceeding from top to bottom to facilitate removal from a mold during manufacture.

To guide the knife (not shown) which makes the circumferential cut 30, an annular recess or channel 59 is molded into the closure's outer wall adjacent the intersection of the ring 20 and the cap 16. As best seen in FIGS. 2 and 3, the thickness of the ring 20 is smallest at the annular channel 59 which facilitates formation of the circumferential cut 30.

The preferred gaging means includes at least one gaging post 60. Each gaging post 60 is located directly adjacent and in abutting relation to one of the connecting posts 36. Each gaging post 60 has a radial dimension smaller than that of the adjacent connecting post 36. For example, the gaging posts may extend radially inwardly for about 0.010 in. from the inner surface of the ring at a location opposite from and interior of the circumferential channel 50 and the cutting post may extend radially inwardly for 0.025 in. from the inner surface. Ideally, the circumferential cut 30 extends partially into the gaging posts 60, but not entirely therethrough, as best seen in FIG. 6A.

As best seen in FIG. 6A, the channel 59 is defined by upper and lower horizontal shoulder surfaces **59*a* and 59*b* with a vertical web surface 59*c* therebetween. The cut 30 extends radially inwardly through the web surface 59*c* and through the inner surface 59*d* of the ring 20. The cut 30 extends radially inward to form an annular surface 30*a* inside of the gaging posts 60 and the connecting posts 36. The cut stops short of the vertical inner surfaces 60*a*** of the gaging posts when the cut is of the proper depth.

It will be appreciated that if the cut extends into a gaging post 60, it will extend entirely through the thickness of the ring 20 adjacent the gaging post 60. As described in greater detail below, inclusion of gaging posts 60 as described above enables the depth of the cut 30 to be determined automatically using optical detection apparatus 50 for detecting transmission of light through the circumferential cut 30.

The preferred optical detection apparatus 50 includes a light source 62 and a detector 64, one of which is located within the closure 10 and one of which is located outside of the closure 10 during testing, and means to enable the reception of light from the light source by the detector to be used to determine the widths of any portions of the closure 10 extending across the cut 30. The closure 10 is rotated while a beam of light 66 is directed from the light source 62 toward the detector 64 through the circumferential cut 30. Each uncut portion which extends across the cut 30 is detected as an interruption in the beam of light 66. Ideally, the cut 30 will permit passage of light about its entire circumference except at the locations where the light is blocked by the gaging posts 60 and connecting posts 36.

The detection apparatus 50 measures the width of each portion of the cut 30 where light is blocked. If the cut has been made to the proper depth, these portions will be identical in number to the connecting posts 36 and each portion will have a dimension equal to the combined width of a connecting post 36 and its adjacent gaging post or posts 60. If light is blocked at more locations than this, it can be inferred that the cut 30 is too shallow. If the width of a particular blocked portion is equal to the width of a connecting post 36 alone, it can be inferred that the cut is too deep and has cut entirely through the adjacent gaging post or posts 60. Of course, if a connecting post 36 has been entirely severed, light will pass uninterrupted through the cut where the connecting post should be, and this will indicate that the cut is much too deep.

Herein, each connecting post 36 and gaging post 60 is generally in the shape of a parallelpiped, and two gaging posts 60 are provided for each connecting post 36, one on each side of the connecting post 36 and formed integrally therewith. This provides connecting post-gaging post structures 67 of T-shaped cross section in plan, as shown in FIG. 5.

In the illustrated embodiment, the closure 10, which is of the 28 mm size, has an outer diameter of about 1.25 in. The closure has eight connecting posts 36 evenly spaced about its circumference. Each connecting post has a length or vertical dimension of approximately 0.110 in., a width or circumferential dimension of approximately 0.015 in., and a depth or radial dimension of approximately 0.025 in. Herein, each gaging post 60 has a length or vertical dimension of approximately 0.04 in., a width or circumferential dimension of 0.010 in. and a depth or radial dimension of 0.010 in. Ideally, the circumferential cut extends approximately 0.007 in. into the gaging posts, leaving about 0.003 in. uncut. Manifestly, for different sizes of closures the dimensions will be varied and the dimensions given herein are by way of example only and are not by way of limitation.

Posts 36 and 60 of the above dimensions disposed in the above-described configuration have been found to provide a connection which is of sufficient strength to maintain integrity of the closure 10 during installation of the closure 10 on a threaded container neck 14, but which is weak enough to enable the lower portion 32 of the ring 20 to separate neatly from the cap 16 as the cap is unscrewed.

Turning to the method of the present invention, the preferred method of manufacturing the above-described closure generally includes the steps of molding a blank 68 (FIG. 6) comprising a cap 16 and a tamper-indicating ring 20; forming a circumferential cut 30 or gap through a portion of the ring 20; and testing the blank 68 to determine whether the cut 30 or gap is within acceptable tolerances.

Molding of the blank 68 may comprise a known molding process, such as injection molding. After molding, the blank is removed from the mold. Depending upon the mold configuration and various other factors, the blank may be rotated to unscrew it from the mold, or may simply be stripped from the mold.

The circumferential cut 30 or gap is preferably formed by placing the blank 68 on a turntable or spindle and rotating it while a knife (not shown) is maintained at a fixed location to produce a cut 30 of uniform radial depth. As noted above, the depth of the cut 30 should be greater than the thickness of the ring 20 so as to cut entirely through the thickness of the ring about the entire circumference thereof, and the cut should extend partially into the gaging posts 60, but not entirely therethrough.

After the cut 30 has been formed, the blank 68 is tested to determine whether the cut has been made properly. Referring particularly to FIG. 6, this may be accomplished by rotating the blank 68 on a spindle 70 with a light source 62 located inside of the closure, directing a beam of light 66 radially outward through the circumferential cut 30, and detecting discontinuities in the transmission of light through the cut with a light detection device 64 located outside of the blank 68 in the path of the beam 66. The illustrated cut may be only about 0.003 in. wide and the cut surfaces tend to come together, at least at certain locations, after the cutting operation has been completed. Thus, a mechanical spreader 72 may be used to separate the gap and enable the light to be transmitted through the cut. The preferred spreader includes a wheel 72*a* which extends into the cut 30. As the blank 68 rotates, the wheel 72*a* separates the lower portion 32 of the ring 20 from the upper portion 34 of the ring 20 adjacent the beam of light 66. The beam is preferably a laser beam.

The preferred method of measuring the combined widths of the connecting post and its adjacent cutting posts is to measure the number of counts that a light beam is interrupted by them as the blank 68 is rotated on a spindle 70. Herein, a commercially available encoder 69 (FIG. 6) is driven by the spindle 70 so that corresponds to the blank speed and this shaft encoder generates a predetermined number of pulses, e.g. 1000 pulses, per shaft revolution. A light source 62 generates a continuous laser beam 66 interiorly of the blank and a light detector exteriorly of the blank receives the light beam unless it is interrupted by connecting posts 36 and/or adjacent gaging posts 60. The light detector should thus furnish six interrupted pulses equally spaced in the 1000 pulse count for a revolution with each interrupted pulse being of substantially the same length when the cut is properly made. The number of pulse units detected by the light detector at each of the six post locations is sent to the comparator for comparison with the pulse units from the shaft encoder. If these counts are of the proper number and occur at each of the proper locations in the count from 1 to 1000, then the cap passes inspection. If the light detector provides a pulse of a number of units less than the predetermined number of units corresponding to the width of a connecting post and a pair of gaging posts, this indicates that one or more of the gaging posts has been severed. If during the count from 1 to 1000 by the shaft encoder, the light detector detects an interruption at a location other than at a post location, this means that the cut was not made in the ring 20 at a location between the posts and that the cap should be rejected. Thus, when the light detector detects interruptions of the light beam at only six equally spaced locations in a count from 1 to 1000, there is assurance that each of the six connecting post locations are causing the beam interruption rather some intermediate portion in the ring 20 that may not have been severed. The absence of a pulse at a connecting post location indicates that the gauging and the connecting posts have been severed. This pulsed method is preferred as the speed of spindle rotation need not be at a constant speed throughout a revolution or at a constant speed from one blank to the next blank as the number of pulses are independent of time with respect to a shaft revolution, i.e., there being 1000 pulses irrespective of the spindle rotational velocity.

Alternatively, in accordance with another embodiment of the invention, the beam 66 is continuous and the blank 68 is rotated at a predetermined speed. In this embodiment, the detection apparatus 50 measures the time length of any interruptions of the beam 66, which are caused by the presence of uncut portions extending between the upper and lower portions 34 and 32 of the ring 20. If the circumferential cut 30 has been made to the proper depth, each interruption corresponds to the combined widths of a connecting post 36 and its adjacent gaging posts 60, and each interruption will have a predetermined time length. If the length of an interruption corresponds to the width of a connecting post 36 alone, then it may be inferred that the cut 30 is too deep at that location and has cut entirely through the adjacent gaging posts 60. If the number and/or lengths of the interruptions are too great, it may be inferred that the depth of the cut 30 is not great enough at some locations, and that the cut has not entirely penetrated the thickness of the ring 20.

In a still further embodiment, the beam of light 66 is pulsed rather than continuous. The pulsing is timed to the rotation of the spindle 70 upon which the blank 68 is mounted, so that a predetermined number of pulses are emitted by the light source 62 during each increment of rotation of the blank 68. For example, the light source may emit 1,000 equally spaced pulses per rotation of the spindle 70. In this embodiment, the detecting apparatus 50 counts the pulses to determine the widths of members extending across the circumferential cut 30. This provides digital data for comparison with predetermined counts of pulses corresponding to an ideally formed closure. If the number of pulses blocked by a particular connecting post 36 and its adjacent gaging posts 60 is too small, it may be inferred that the gaging posts 60 have been cut through entirely by the knife. If the number of pulses blocked is too large, it may be inferred that some portions of the ring 20 have not been cut entirely through.

In each of the embodiments described above, the preferred detector 64 has a generally rectangular face for receiving the light beam 66. Both the light source 62 and the detector 64 preferably have dimensions in the direction of the axis of the closure great enough so that small variations in the axial location of the cut 30 between the various closures will not require readjustment of the axial locations of the light source 62 and detector 64. It will be appreciated that in either embodiment the light source 62 may be placed outside of the closure and the light detector 64 placed within the closure as an alternative to the above-described arrangement.

In a fourth embodiment, the testing is accomplished by measurement of deflection of the ring 20 in response to pressure, rather than by directing a beam of light through the cut 30. In this embodiment, pressure is directed radially inward at various points on the lower portion 32 of the ring 20, and the deflection of the ring in response thereto is measured. If the cut has been made properly, the lower portion 32 of the ring 20 will deflect significantly more at points relatively distant from any connecting post 36 than at points relatively close to a connecting post 36.

The final step of the methods of the embodiments described above comprises bending the tabs 48 radially inward and upward to finish the closure. As described in above-referenced copending application Ser. No. 467,873, heat may be applied to the joints 72 at which the tabs 48 are bent to set them in their final configurations.

From the foregoing, it will be appreciated that the present invention provide a novel and improved method of manufacturing tamper-evident closures, and provides a novel tamper-evident closure which may be manufactured by this method. While preferred embodiments of the invention have been described in detail above, the invention is not limited to these or other illustrated embodiments of the invention.

What is claimed is:

1. A method of manufacturing a tamper-evident closure, the method comprising the steps of:

molding a blank which comprises an internally threaded cap, a generally cylindrical ring disposed beneath the cap and spaced therefrom, breakable connecting posts extending downward from the cap radially inward of the ring, and a plurality of gaging posts, each disposed adjacent one of the connecting posts and having a radial dimension smaller than that of the adjacent connecting post, and making a circumferential cut through the ring to divide the ring into an upper portion and a lower portion, the cut extending through the thickness of the ring and partially but not entirely through the gaging posts.

2. A method in accordance with claim 1 comprising the additional step of testing the closure after making the circumferential cut through the ring to determine the depth of the circumferential cut.

3. A method in accordance with claim 2 wherein the step of testing the closure comprises the steps of:

rotating the blank at a predetermined speed;

widening the cut at a predetermined location;

producing light at a first location as the blank rotates so that light passes through the cut adjacent said predetermined location;

detecting light at a second location as the blank rotates, one of said first and second locations being within the blank and the other being outside of the blank, so as to measure the lengths of the time intervals during which light passes between said first and second locations through the cut during a rotation of the blank; and comparing the lengths of the time intervals during which light is detected with predetermined values associated with a properly configured blank.

4. A method in accordance with claim 2 wherein the step of testing the closure comprises the steps of rotating the blank on a shaft about an axis substantially perpendicular to the circumferential cut;

producing a continuous beam of light and directing the light beam through the cut;

detecting interruption of the light beam by the connecting posts and gaging posts as the blank rotates, generating a predetermined number of electrical pulses from a shaft encoder connected to the shaft rotating the blank, and comparing the number and location of pulses that the laser beam is interrupted to a predetermined number and location of pulses for the preferred width and spacing of the gaging and connecting posts.

5. A method in accordance with claim 2 wherein the step of testing the closure comprises the steps of rotating the blank about an axis substantially perpendicular to the circumferential cut;

widening the cut as the blank rotates;

producing a series of light pulses at a first location in timed relation to the rotation of the blank;

detecting light pulses at a second location as the blank rotates, one of said first and second locations being within the blank and the other being outside of the blank; and correlating the detection of pulses with the rotation of the blank to determine the circumferential dimension of any portions of the blank extending across the circumferential cut between the upper and lower portions of the ring.

6. A method in accordance with claim 2 wherein the step of testing the closure comprises the step of applying pressure directed radially inward to the lower portion of the ring at predetermined locations between the connecting posts and measuring the radial deflection of the ring in response to the pressure.

7. A tamper-evident closure for sealing an open-topped container having an external screw thread and an annular projection below the screw thread, the closure comprising:

an internally threaded cap which may be removed from the container for dispensing the contents of the container;

the cap comprising a top wall for extending across the open top of the container, an annular sidewall integrally joined to the top wall about the periphery of the top wall and depending therefrom, and an internal screw thread formed on the inside of the sidewall for engagement with the external screw thread on the container; and tamper-indicating means comprising a ring located below the annular sidewall and spaced therefrom, breakable connector means for detachably connecting the ring to the sidewall, and means for engaging the annular projection on the container during removal of the cap to prevent the lower portion of the ring from traveling upward beyond the annular projection with the cap so as to cause the lower portion of the ring to break away from the cap during removal of the cap from the container;

the breakable connector means comprising a plurality of circumferentially spaced connecting posts formed radially inwardly of the ring, connecting the annular sidewall of the cap to the ring, and a plurality of gaging posts extending radially inward of the ring, each gaging post being located immediately adjacent a connecting post and having a radial dimension smaller than that of the adjacent connecting post.

8. A closure in accordance with claim 7 wherein the connecting posts are eight in number.

9. A closure in accordance with claim 7 wherein each connecting post has a gaging post located on each side of it and directly adjacent it.

10. A closure in accordance with claim 7 wherein each gaging post is formed integrally with the adjacent connecting post.

11. A closure in accordance with claim 7 wherein each connecting post is shaped generally as a parallelpiped.

12. A closure in accordance with claim 11 wherein each gaging post is shaped generally as parallelpiped.

13. A closure in accordance with claim 12 wherein each connecting post has a gaging post formed integrally on each side to define a generally T-shaped cross-section in plan.

* * * * *